United States Patent [19]

Lehmann

[11] Patent Number: 4,566,360

[45] Date of Patent: Jan. 28, 1986

[54] CUTTING DEVICE FOR SHEETS WITH AT LEAST ONE ROTATING CUTTING KNIFE AND CONVEYER

[75] Inventor: Gunthart Lehmann, Lautern, Fed. Rep. of Germany

[73] Assignee: Maschinenbau Oppenweiler GmbH, Fed. Rep. of Germany

[21] Appl. No.: 556,448

[22] Filed: Nov. 30, 1983

[30] Foreign Application Priority Data

Dec. 1, 1982 [DE] Fed. Rep. of Germany ..... 3244422

[51] Int. Cl.[4] ..... B26D 7/06

[52] U.S. Cl. ..... 83/409; 83/425; 83/435.2; 83/925 A; 198/628

[58] Field of Search ..... 83/409, 422, 425, 425.1, 83/425.2, 425.3, 425.4, 434, 435.2, 885, 925 A; 198/628, 779

[56] References Cited

U.S. PATENT DOCUMENTS

| | | | |
|---|---|---|---|
| 2,158,675 | 5/1939 | Davies | 198/628 |
| 2,546,476 | 3/1951 | Schefe | 198/779 |
| 3,292,767 | 12/1966 | Lobdell et al. | 198/779 |
| 3,386,565 | 6/1968 | Carter | 198/628 |
| 3,606,810 | 9/1971 | Kozij | 83/549 |
| 3,951,257 | 4/1976 | Storace et al. | 198/628 |
| 4,075,917 | 2/1978 | Kistner et al. | 83/422 |

*Primary Examiner*—Frank T. Yost
*Assistant Examiner*—Hien H. Phan
*Attorney, Agent, or Firm*—Wigman & Cohen

[57] ABSTRACT

A cutting device for sheets as well as booklets with at least one revolving blade and a conveyer device. The conveyer device with which the material to be cut is transported by the cutting knife of the cutting device, and has at least one endless conveyer element which presses onto the material. This is pressed against the material by a pressure device that is spring loaded and rests against it. This pressure device consists of individual pressure pieces, arranged in a row in the running direction of the conveyer element, each of which is spring loaded independently from the others and mobile in the direction of stress. By the independent spring responsive mobility of each individual pressure piece, the contour of the conveyer element adapts automatically to the possibly irregular contour of the material to be transported. A lateral guide device avoids shifting crosswise to the running direction under the influence of crosswise forces during the cutting process.

13 Claims, 6 Drawing Figures

CUTTING DEVICE FOR SHEETS WITH AT LEAST ONE ROTATING CUTTING KNIFE AND CONVEYER

BACKGROUND OF THE INVENTION

This invention concerns a cutting device for folded and unfolded sheets, as well as booklets, with at least one rotating cutting knife and one conveyer which transports the material to be cut at least during the cutting process. The device also has at least one endless conveyer element which presses onto the material along a part of its length, and at least along this section, lies under spring pressure, with its side that is removed from the material to be cut, against a pressure device that extends in the lengthwise direction of the conveyer.

A cutting device of this type is already known, see German DE-OS No. 25 14 836.1. The conveyer element disclosed in this patent consists of a drivable V-belt, the slack side of which, running in the transport direction above the material, is pressed by a spring and a pressure device against the top side of the material which is lying on a lower transport element which, in the pressure area, i.e. the section in which the pressure device presses the V-belt against the material, is supported from below. This lengthwise section extends from a spot located at a distance from the cutting spot of the cutting knife, corresponding to about the length of the material, to a spot behind the cutting spot which is at about the same distance. The pressure device has the shape of an elongated spring-charged plate, extending in the lengthwise direction of the V-belt, of which both short sides are rounded and of which the outer rim is worked along all its sides in such a manner that an endless roller chain can run around the plate. Along the lower lengthwise side of the spring-charged plate, the roller chain presses against the inside upper side of the lower side of the V-belt, so that the lower belt side is pressed, along the pressure section, with its outside lower side against the material to be transported.

When cutting folded or unfolded sheets, as well as booklets, the quality of the cut depends on the material being perfectly clamped in the cutting area. The known cutting device is not fully satisfactory in this respect, because if there are variations in thickness in the piles, booklets or sheets, it is possible that individual sheets, booklets or piles will not be clamped firmly, as required for a clean cut.

SUMMARY AND OBJECTS OF THE INVENTION

An object of the invention is to create a cutting device in which a correspondingly secure clamping of the material is guaranteed.

In a cutting device of the type mentioned earlier, this object can be solved by using individual pressure pieces, which are spring-charged in themselves, in place of a pressure device in the shape of a rigid plate or rail. The clamping thus adapts itself in the area of each pressure piece to the possibly varying thickness of the material in question, so that a perfect clamping effect is obtained in each case. The area-wide adaption of the clamping gap also provides for each additional advantage that the device according to the invention, contrary to the known devices of this type, is also suitable for the treatment of material in which the individual parts, sheets, booklets or piles, are not fed in at a distance from each other, but where the parts are arranged in a scale like manner, partly on top of each other, i.e., a so-called scaled feed (Schuppenstrom). By the independent spring-loaded mounting of the individual pressure pieces, the clamping gap adapts to the wave-like contour of the scaled feed, so that the perfect cut is guaranteed also in this case. The lateral guiding of the pressure pieces makes sure that the lateral forces that become effective during the cutting process do not lead to a lateral movement of the material to be cut, together with the pressure pieces.

An especially secure clamping effect is obtained, particularly when working on scale-fed goods, in a preferred embodiment in which each pressure piece is mounted pivotably against the spring force, around an axis extending crosswise to the transport direction of the conveyer element in addition to its mobility in the charged direction, vertically to the movement of the transport element.

The design in a preferred embodiment provides for two endless transport elements, each in the form of a roller chain, of which each presses onto the material from above and from below, with the aid of a pressure device, constructed according to the invention. It is thereby advantageous for cutting individual sheets or booklets, to support with springs only the pressure pieces which press from above onto the roller chain that presses onto the material, and to rigidly support the pressure pieces of the other roller chain. However, for cutting a scaled feed, the best clamping can only be obtained when the pressure pieces for the lower roller chain are also mounted with springs.

When using a roller chain as a conveyer element, it is possible to design each of the pressing elements to a segment of the roller chain.

In another embodiment the pressure force is transmitted to the material by a flexible endless band which lies on the outside of the endless conveyer element, whereby this band consists preferably of a material with high static friction, so that the material is held securely by the non-skid position of the band in the area of pressure.

With the foregoing and other objects, advantages and features of the invention that will become hereinafter apparent, the nature of the invention may be clearly understood by reference to the following detailed description of the invention, the appended claims and to several views illustrated in the attached drawings.

BRIEF DESCRIPTION OF THE DRAWINGS

The invention is described in detail below using the model shown in the drawing.

DETAILED DESCRIPTION OF A PREFERRED EMBODIMENT

Figure 1:
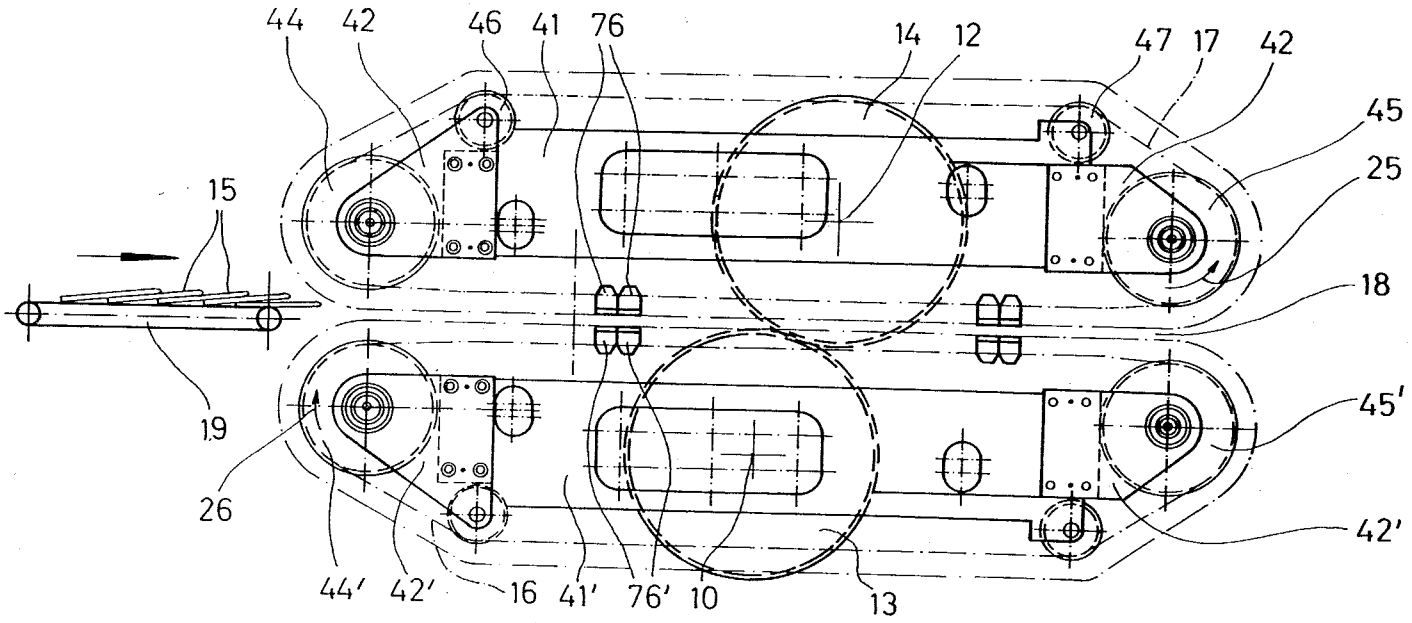
FIG. 1 is a lateral view of a model of a cutting device for scaled feed in a schematically simplified and partially cut open view.

The cutting device has a frame which is not shown, on which are mounted an upper drivable revolving blade 14 with a rotation axis 12 firmly attached to the frame and a lower drivable revolving blade 13, whose rotation axis is designated by 10. The drive for the revolving blades 13 and 14 is not shown in the drawing. In order to feed booklets to the revolving blades 13 and 14 there is a conveyer device which has two endless conveyer elements, a lower roller chain 16 and an upper roller chain 17 arranged above each other in such a manner that two adjoining links of the roller chains 16 and 17 form a clamping gap 18 between themselves, in which booklets 15 can be fed clamped to the cutting area where the revolving blades 14 and 13 work together as cutting edge and counter cutter for the cut. The booklets 15 are transported to the feeding area 19 of the clamping gap 18 by means of a conveyer device 19.

As can be seen from FIG. 1, the rotation axes 12 and 10 for the revolving blades 14 and 13 are somewhat offset from each other in the conveyer direction. This offsetting is especially advantageous for obtaining a clean cut. The amount of offsetting can be adjusted to the optimal value in each case by shifting the rotation axis 10 of the lower revolving balde 13 in the conveyer direction. The device for shifting the rotation axis 10 is not shown.

Figure 3A:
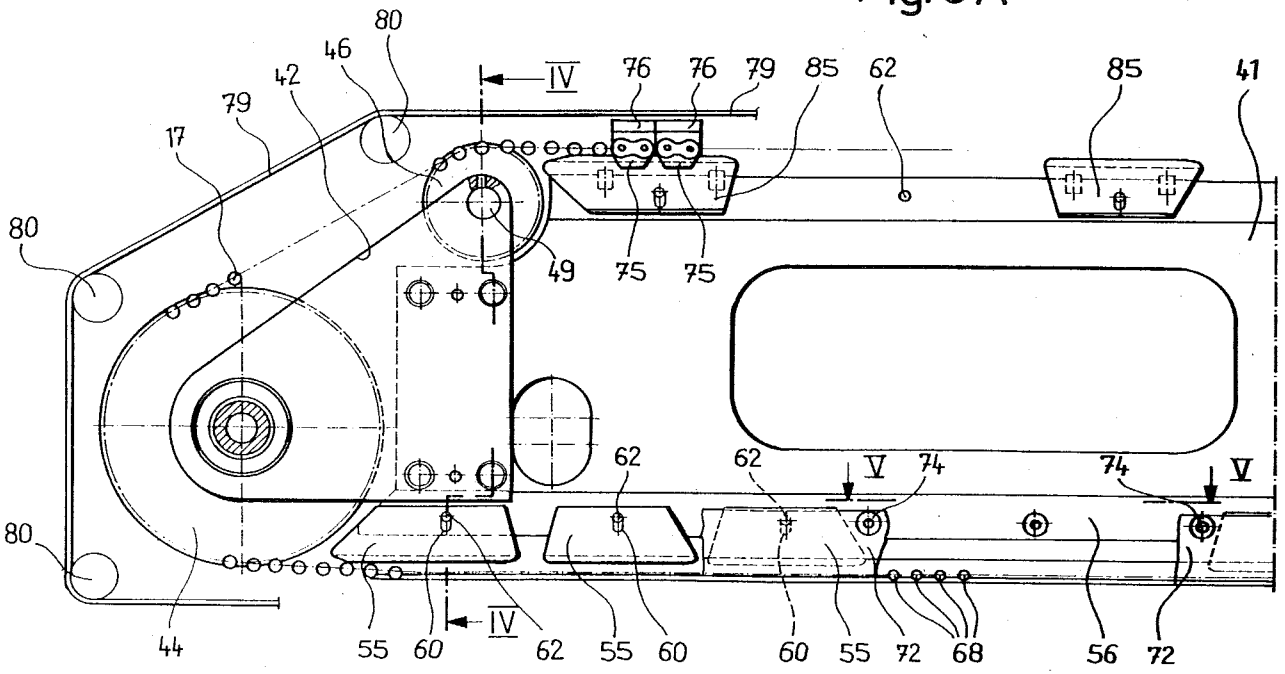
FIG. 3A and 3B are lateral views of the back and forward part—relative to the conveyer direction—of one of the two pressure devices of the model with the appertaining conveyer element, whereby the pressure device is shown in larger scale compared to FIG. 1 and also broken open.
Figure 4:
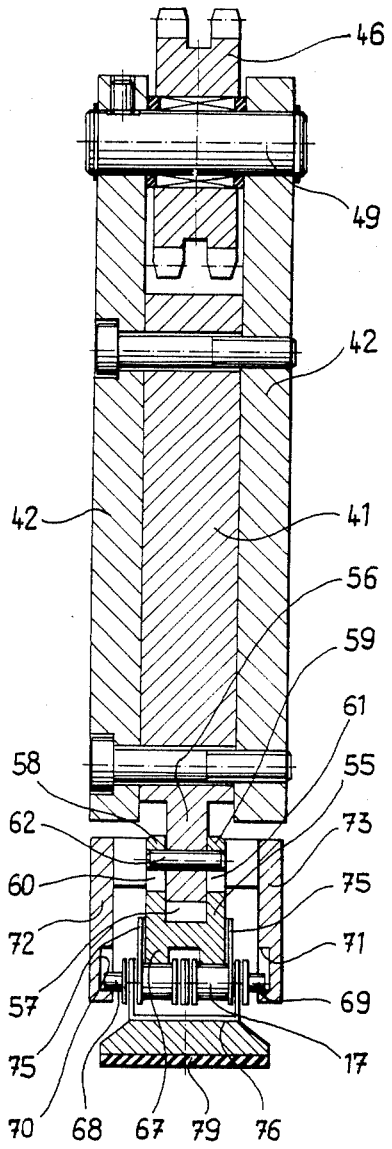
FIG. 4 and 5 are cross sections along the lines IV—IV and V—V in FIG. 3A, drawn in larger scale.
Figure 5:
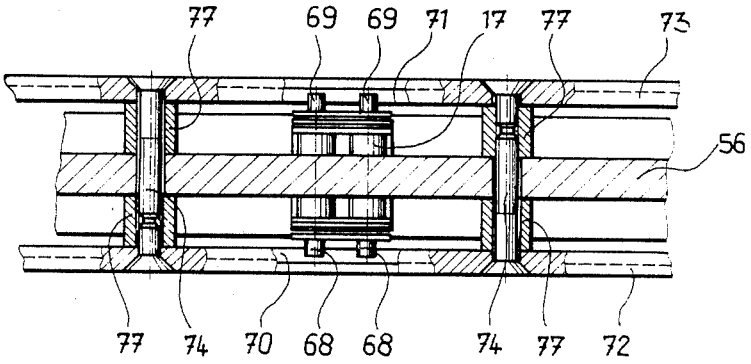

The pressure device which presses the roller chains 16 and 17 against each other in the area of the clamping gap 18, in order to clamp the booklets 15 which are in the clamping gap 18, is constructed identically for both roller chains 16 and 17 in the model according to FIG. 1, which is designed as the upper conveyer element and shown in FIG. 3 and 5. The corresponding details of the pressure device installed for the roller chain 16—as can be seen in FIG. 1—are designated there by the same number primed (e.g. 45—45') as those for the same parts in the pressure device explained in detail with FIGS. 3 to 5.

The pressure device for the roller chain 17 has an elongated main support 41 in the shape of an essentially rectangular plate which is fixed to the frame and mounted lengthwise above the transport belt for the booklets 15 which extends essentially across the whole pressure area of the clamping gap 18. At the front and back end, relative to the transport direction of the booklets 15, the main support 41 has in each case a pair of laterally screwed on plate shaped cheeks 42 and 43, which form extensions to the back and front for the main support 41. Between each pair of cheeks 42 and 43 there is a deflection roller 44 and 45, respectively, mounted in a rotatable manner, over which the roller chain 17 is led. The rollers 44 and/or 45 are driven by a drive device (not shown) in the direction indicated in FIG. 1 by arrows 25 and 26. The upper section of the roller chain 17 is also led across chain wheels 46 and 47 which are located above and to the side of the deflection rollers 44 and 45. As can be seen especially from FIGS. 3 and 4, the chain wheel 46 is mounted between the upper ends of the cheeks 42 and is freely turnable on a plug 49. The other chain wheel 47, pertaining to the upper segment of the roller chain 17, is mounted above and to the side of the deflection roller 45, and is meant to be a chain adjuster. See FIG. 3B. It is rotatably mounted in a bearing block 50, which is arranged along a guide groove 51 on the main support 41, and is adjustable in its lengthwise direction. There is an adjustment screw 52 for positioning, see FIG. 3B, which sits in a lengthwise threaded bore in the main support 41, and whose head is supported by the bearing block 50. To determine the desired position of the bearing block 50, there are clamping screws 53, which extend through borings in the bearing block 50 as well as oval holes 54 in the main support 41.

Figure 3B:
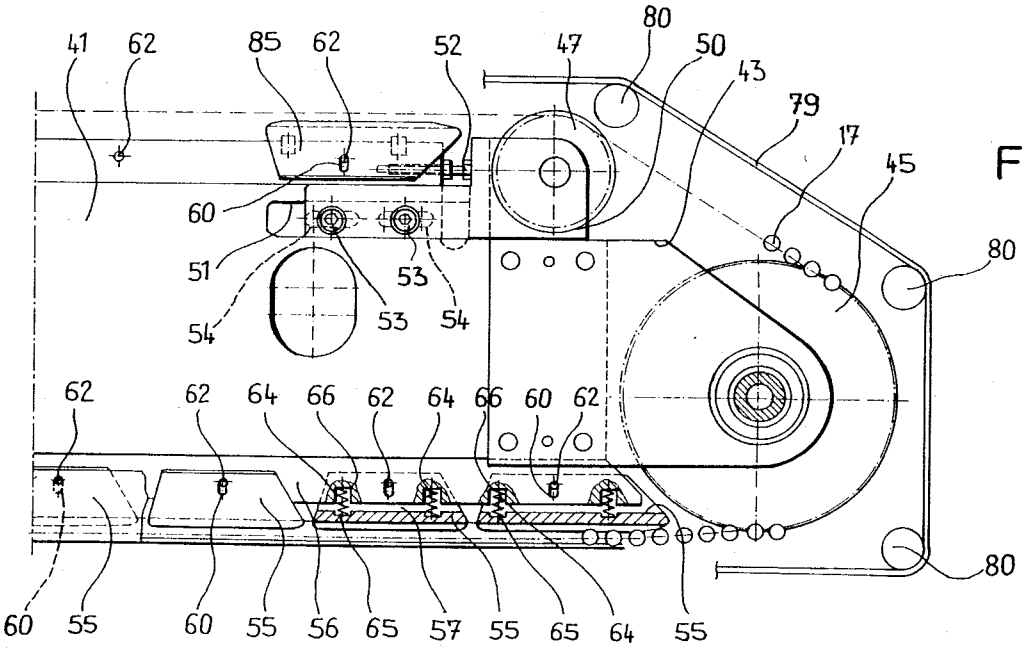

The lower section of the roller chain 17 does not sit directly on the main support 41, but is led across a row of pressure pieces 55, which—as can be seen especially from FIGS. 3B and 4—are arranged, movably against a spring force, at the smaller lower lengthwise edge 56 of the main support 41 (see especially FIG. 4). The mobile bearing of the pressure pieces 55 along the lengthwise edge 56 of the main support 41 is identical in each pressure piece 55 and has—as can be seen in FIG. 3B and 4—a central, lengthwise guide groove 57, open towards the top, which is cut into the pressure piece 55 and grips slidingly the lengthwise edge 56. In the walls 58 and 59, which dilineate the guide groove 57 laterally, the pressure piece 55 has coordinated elongated holes 60 and 61, into which extends a rod 62 for the purpose of a slit-plug connection between the lengthwise edge 56 and the pressure piece 55. The rod 62 is pressed into the lengthwise edge 56 and engages the holes 60 and 61 with its ends which protrude from the plane of the lateral surfaces of the lengthwise edge 56. The expansion of the elongated holes 60 and 61 extends along the direction in which the roller chain 17 exerts the clamping force onto the booklets 15, i.e. in this case, where the clamping gap 18 runs horizontally, the elongated holes extend in a vertical direction. Thereby the vertical length of the elongated holes 60 and 61 and the depth of the guide groove 57 are of such dimension that the pressure piece 55 can be shifted in the direction of stress between a fully advanced position, as shown in FIG. 4 and corresponding to the smallest dimension of the clamping gap 18, and a pushed back position corresponding to one of the largest dimensions of the clamping gap.

On its side which is opposite the opening for the guide groove 57, each pressure piece 55 forms a guide 67 for the roller chain 17 which has guide plugs 68 and 69 which protrude laterally from the rollers. These plugs 68, 69 engage into grooves 70 and 71 which extend into lateral guide rails 72 and 73 along the transport direction of the roller chain 17. The guide rails 72 and 73 are connected, in the gaps between the pressure pieces 55, with screws 74 and separators 77 (FIG. 5) to the lengthwise edge 56 of the main support 41, in a fixed manner. The width of the grooves 70 and 71 in the direction of stress is chosen in such a manner that the plugs 68 and 69 which extend into them, rest against one edge of the grooves 70, 71 in the full forward position shown in FIG. 4, and against the other edge in full backward position of the pressure pieces 55.

It can be seen in FIGS. 3A and 4 that the brackets of the roller chain 17 are enlarged towards the inside and outside so that the inside guide brackets 75 sit laterally against the outer surface of the pressure pieces 55. The pressure elements 76 are formed, protruding towards the outside, through which the pressure force is transmitted onto the booklets in the pressure gap 18. The pressure elements are, as shown in FIG. 4, connected to the roller chain, transversely without play, through brackets, which in turn are led transversely without play, laterally by the pressure pieces 55, through guide brackets 75. For this reason it is possible that the pressure elements 76 can absorb and pass on to the main support 41, without lateral shift, crosswise forces, as they are exerted during the cutting process by the cut material on the pressure elements 76.

As shown in FIGS. 3A and 4, the pressure elements 76 in the model, each of which is coordinated with a chain link of the roller chain 17, do not press directly onto the booklet 15 to be clamped, but through an endless flexible band 79 which surrounds the pressure elements 76 along their outside surfaces. This band 79 consists of a synthetic material with high adhesive friction. As a rule, however, the band 79, which is held away from the pressure elements 76 by deflection rollers 80 in the area of the deflection of the coordinated roller chains 16 or 17, as shown in FIGS. 3A and 3B, is not needed.

The independent, spring resilient arrangement of the pressure pieces 55 creates, during operation, an outline of the pressure elements 76 which adapts to the thickness and outline of the sequence of booklets 15 which are fed in. This adaption is enhanced by the fact that the pressure pieces 55 are mobile not only in the direction of stress, but are also pivotable around the axis of the plug 62 of the slit-plug connection when two pressure springs 64 are pressed together with variable force. The amount of pivoting is limited simultaneously by the width of the grooves 70, 71 in the lateral guide rails 72 and 73. Those grooves 70, 71 also ensure that in a unstressed condition, i.e. when there is no booklet 15 in the clamping gap 18, the pressure pieces 55 are horizontal in the fully advanced position, even if the bias of the two pressure springs 64 in any of the pressure pieces 55 is not exactly identical. The rotating movement of the roller chain 17 is also not hampered to any extent when the protruding plugs 68 and 69 touch the limiting surfaces of the grooves 70, 71 in the guide rails 72 and 73, as the guide rails 72 and 73 are constructed from a synthetic material with good gliding properties.

In addition to the pressure pieces 55 which are installed along the lower bands of the roller chain 17, similarly constructed upper pressure pieces 85 are planned which are installed in a spring resilient shiftable way and pivotably similar to the lower pressure pieces 55, and serve as devices to keep the roller chain 17 taut, as it is led with its upper belt over the upper pressure pieces 85.

Figure 2:
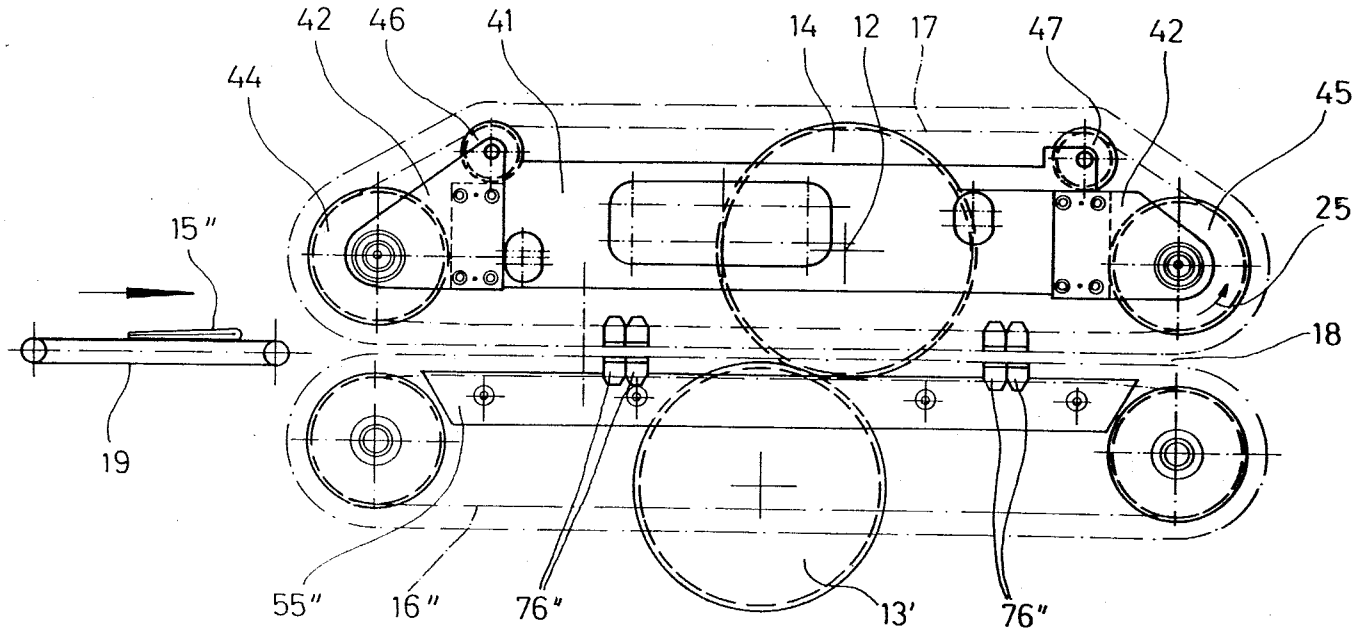
FIG. 2 is a lateral view according to FIG. 1 of the model for cutting individual booklets or sheets.

The model according to FIG. 2, designed for cutting individual booklets 15'', varies from the above described model only by the fact that the pressure elements 76'' and the lower roller chain 16'' supporting it, are not led and supported by pressure pieces like the pressure pieces 55 in the area of the clamping gap 18, but instead by a rigid guide rail 55''. Similar to pressure pieces 55, this rail 55'' secures the roller chain and its pressure elements against a lateral shift, i.e. also forms a lateral guide. This guide rail is attached to the frame in such a manner that the contact surface of the pressure elements 76'', facing upward in the clamping gap 18, defines a plane surface which is touched by the lower revolving blade 13''.

Although only preferred embodiments are specifically illustrated and described herein, it will be appreciated that many modifications and variations of the present invention are possible in light of the above teachings and within the purview of the appended claims without departing from the spirit and intended scope of the invention.

What I claim is:

1. A cutting device for folded and unfolded sheets, as well as booklets, with at least one rotating cutting knife and one conveyer which transports the material to be cut at least during the cutting process, said device comprising:

a first endless conveyer element which is pressed onto the material along a part of its length by spring pressure exerted on its side opposite the material to be cut, a pressure device extending in the lengthwise direction of the conveyer, said pressure device including pressure pieces individually installed in the direction of the conveyer element, each pressure piece being spring loaded, independently from the others, and movable in a direction, perpendicular to a plane of the conveyer element as the conveyer element passes adjacent to the pressure device, wherein each pressure piece is fixed laterally, relative to the running direction of the conveyer element;

wherein each pressure piece is installed in a manner allowing it to swivel around an axis extending crosswise to the running direction of the conveyer element;

further comprising a slit-plug connection for connecting each pressure piece to a support on a frame, wherein the slit extends in the direction of the pressure and at least one pre-stressed spring is supported in the running direction of the conveyer element on each side of the slit-plug connection by the pressure piece on the one hand, and by the support on the other hand;

further comprising a second endless conveyer element, one from above and the other from below, which presses onto the material by means of the pressure devices, and which are arranged facing each other with the material between them, in order to form a clamping gap;

wherein each endless conveyer element has an endless roller chain which has plugs that protrude on both sides, and that in the area of the pressure pieces there are two guide rails mounted firmly to the frame, which receive these plugs, whereby each rail has a guide slit, the lower delineating lateral side surface of the slit, located closest to the material to be cut, determines the shortest distance from the material to be cut for the plugs extending into them, while the upper delineating surface determines the largest distance.

2. The cutting device according to claim 1, wherein the guide slits are constructed as grooves in the sides opposing each other in the guide rails and are made from a synthetic material with good gliding properties.

3. The cutting device according to claim 1, wherein each pressure element is provided for on a link of the conveyer element.

4. The cutting device according to claim 1, wherein each endless conveyer element has individual pressure elements which can be pressed against the material to be transported, and which form a row in the lengthwise direction of the conveyer element.

5. The cutting device according to claim 4, further comprising a flexible endless band resting against the outside of the endless conveyer element.

6. The cutting device according to claim 5, wherein the band consists of a material with high adhesive friction.

7. The cutting device according to claim 6, wherein the band is reinforced by non-flexible fibres or steel ropes in order to avoid a lengthwise expansion, and that it has an uninterrupted frame for lateral guidance, which is provided for on the side of the band removed from the clamping gap.

8. A device for cutting folded and unfolded sheets; comprising:

a cutting means;

an endless conveyer means for conveying the sheets to the cutting means;

means for pressing the conveyer means onto the sheets extending in the lengthwise direction of the endless conveyer means, said pressing means including pressure pieces individually installed in the direction of the conveyer means, each pressure piece being spring loaded, independently of each other, and movable in a direction perpendicular to a plane of the portion of the conveyer means adjacent the pressure piece;

pressure elements mounted on the pressure pieces; and means for moving the pressure elements around an endless path in the direction of travel of the conveyer means;

wherein the endless conveyer means has an endless roller chain which has plugs that protrude on both sides thereof, and that in the area of the pressure pieces there are two guide rails mounted firmly to a frame, which receive these plugs, whereby each rail has a guide slit having upper and lower delineating surfaces, the lower delineating surface of the slit is located closest to the material to be cut and determines the shortest distance from the material to be cut for the plugs extending into them, while the upper delineating surface determines the largest distance.

9. The cutting device according to claim 8, wherein each pressure piece has an abutment surface for abutting the conveyer means that extends in the running direction of the conveyer means.

10. The cutting device according to claim 9, further comprising a second endless conveyer means that cooperates with the first endless conveyer means for conveying the sheets to the cutter.

11. The cutting device according to claim 10, wherein the sheets are pressed between the two endless conveyer means when being conveyed to the cutting means.

12. The cutting device according to claim 11, further comprising pressing means and pressure pieces cooperating with the second endless conveyer element.

13. The cutting device according to claim 9, wherein the pressing means is movable with respect to the cutting device in a direction perpendicular to the plane of a portion of the conveyer means adjacent the pressing means.

* * * * *